US007507330B2

(12) United States Patent
Weiss et al.

(10) Patent No.: US 7,507,330 B2
(45) Date of Patent: Mar. 24, 2009

(54) METHOD FOR HIGH-TEMPERATURE SHORT-TIME DISTILLATION OF RESIDUAL OIL

(75) Inventors: Hans-Jurgen Weiss, Oberursel (DE); Udo Zentner, Griesheim (DE); Helmut Heurich, Bad Homburg (DE)

(73) Assignee: Lurgi Lentjes AG (DE)

( * ) Notice: Subject to any disclaimer, the term of this patent is extended or adjusted under 35 U.S.C. 154(b) by 396 days.

(21) Appl. No.: 10/539,715

(22) PCT Filed: Jul. 9, 2003

(86) PCT No.: PCT/EP03/07377

§ 371 (c)(1),
(2), (4) Date: Jan. 31, 2006

(87) PCT Pub. No.: WO2004/056942

PCT Pub. Date: Jul. 8, 2004

(65) Prior Publication Data

US 2006/0138030 A1 Jun. 29, 2006

(30) Foreign Application Priority Data

Dec. 19, 2002 (DE) ..... 102 59 450

(51) Int. Cl.
*B01D 3/06* (2006.01)

(52) U.S. Cl. ..... 208/361; 208/365

(58) Field of Classification Search ..... 208/361, 208/365

See application file for complete search history.

(56) References Cited

U.S. PATENT DOCUMENTS 4,983,278 A * 1/1991 Cha et al. ..... 208/407
6,413,415 B1 7/2002 Serrano et al.
6,841,064 B1 * 1/2005 Weiss et al. ..... 208/361

FOREIGN PATENT DOCUMENTS

DE 199 59 587 A 6/2001
EP 0 832 962 A 4/1998

OTHER PUBLICATIONS

Weiss, H., et al.: "Coking of Residue Oils by the LR Process", Erdol Und Kohle Erdgas Petrochemie, Industrieverlag Von Hernhaussen. Leinfelden, DE, vol. 42, No. 6, Jun. 1, 1989, pp. 235-237, XP002051645; ISSN: 0014-0058.

* cited by examiner

*Primary Examiner*—Tam M Nguyen
(74) *Attorney, Agent, or Firm*—Harness, Dickey & Pierce, P.L.C.

(57) ABSTRACT

The invention relates to a method for a high temperature short-time distillation of residual oil. The method according to the invention is characterized by a technically simple recovery of a small residual fraction from a gas and/or oil vapour mixture produced by a mixing apparatus (1). Said small residual fraction contains large quantities of undesirable polluting catalytic substances (CCR, Ni, V, asphaltenes). For this purpose, the gas and/or oil vapour mixture produced by the mixing apparatus (1) is diluted with gas or water vapour in a column (17) at a temperature of 450° C. in such a way that a high boiling fraction, which has a high content of the pollutant substances and whose initial boiling point is higher than 450° C., is condensed and extracted. Another realization of the method consists in introducing a non condensed oil produced in the column (17) into a fractionating column (19), where said oil is decomposed in order to produce a depressurized gas oil fraction having a low content of pollutants and a benzine/gas oil fraction.

8 Claims, 1 Drawing Sheet

METHOD FOR HIGH-TEMPERATURE SHORT-TIME DISTILLATION OF RESIDUAL OIL

CROSS-REFERENCE TO RELATED APPLICATIONS

Figure 1:
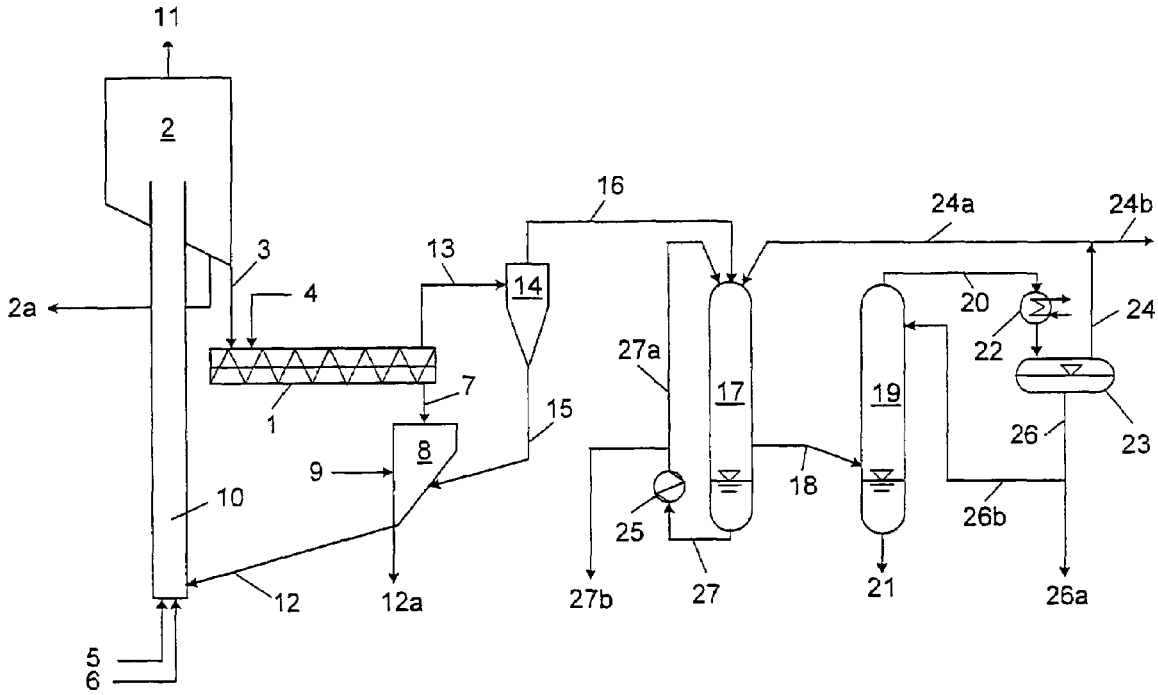

This application is a U.S. National Stage (371) of International Application No. PCT/EP2003/007377, filed Jul. 9, 2003, and published in German as WO 2004/056942 A1 on Jul. 8, 2004, which claims the benefit of German Application No. 102 59 450.3, filed Dec. 19, 2002. The disclosures of the above applications are incorporated herein by reference.

DESCRIPTION

The invention relates to a method for high temperature short-time distillation of a residual oil originating from the processing of crude petroleum, natural bitumen or oil sand, wherein in a mixing apparatus the residual oil is mixed with granular hot coke as heat transfer medium, is converted into oil vapour, gas and coke, and gases and vapours are evacuated from the mixing apparatus while being substantially separated from the granular coke, gases and vapours are cooled down and a product oil in form of condensate as well as gas is produced and wherein the coke, which has been evacuated from the mixing apparatus, is heated again and returned into the mixing apparatus as a heat transfer medium.

Methods of this type are described in DE-C-19724074 as well as in DE-A-19959587. These methods are characterized in that the produced product oil contains pollutants, such as heavy metals (nickel, vanadium), Conradson carbon residue (CCR) as well as asphaltenes in comparison to the used residual oil only in a highly reduced concentration. This is highly advantageous for a subsequent catalytic conversion of the product oil fraction, the boiling point of which is higher than about 360° C., to benzine and gas oil in a Fluidized Catalytic Cracker (FCC). However, if the catalytic conversion of these heavy product oil fractions shall take place in a hydrocracker, the contents of pollutants of the catalyst have to be further reduced because of the higher requirements thereof.

According to experience, the remaining pollutants are concentrated in the highest boiling fraction of the product oil. Thus, a reduction of the pollutants can be principally achieved by a subsequent vacuum distillation of the product oil, that boils above 360° C., in which a pollutant bearing vacuum residue (VR) and an almost pollutant free vacuum gas oil (VGO) are obtained. A disadvantage of this method is that a vacuum distillation requires a high technical effort and can only be carried out up to certain overlapping boiling temperatures of VGO and VR in the range comprised between about 500 and 560° C. This leads to a big amount of pollutant bearing VR, which can be converted in the FCC installation but not in a hydrocracker.

On the base of this state of the art, it is the object of the invention to improve the method for high temperature short-time distillation of residual oils, such that a residual fraction, which is as small as possible and in which the undesirable catalyst pollutants are mainly concentrated, can be obtained from the product oil in a technically simple way.

According to the invention this aim is achieved in that a highly pollutant bearing residual fraction of the vapour product oil from the mixing apparatus is mixed with water vapour or gas in order to reduce the partial pressure and is then condensed at temperatures beneath 450° C. in a column and is extracted while being separated from the other product oil.

Afterwards, the non condensed product oil vapours from the column can be introduced into a fractionating column, in which the remaining product oil, that has a low content of pollutants, is decomposed into a VGO and a benzine/gas oil fraction (e.g. gasoline/gas oil fraction).

The invention makes use of the fact that all of the product oil is in a vapour state at the exit of the mixing apparatus and can be decomposed into the desired fractions by a fractionating condensation. For reducing the portion of highly pollutant bearing VR, the overlapping boiling range of VGO and VR has to be fixed as high as possible in a range comprised between 450° C. and 650° C., such that the separated VR fraction contains more than 60% of the Conradson carbon residue (CCR), which is still contained in the product oil vapours, more than 70% of the heavy metals nickel (Ni) and vanadium (V), which are still contained in the product oil vapours, as well as more than 80% of the asphaltenes, which are still contained in the product oil vapours.

Since condensed oil fractions would quickly decompose or coke at temperatures above 450° C., the partial pressure of the oil fractions to be separated is reduced by introducing water vapour or gas into the column, such that a heavy condensate having an initial boiling point above 450° C. condenses there at temperatures beneath 450° C. The condensation of VGO having a low content of pollutants (initial boiling point of about 360° C.; final boiling point of 450 to 650° C.) and the benzine/gas oil fraction (boiling range of $C_5$ up to about 360° C.) can then be carried out in a second condensation stage at correspondingly lower temperatures. The thus obtained VGO having a low content of pollutants can then be catalytically converted into benzine and gas oil in a hydrocracker and the heavy condensate can either be returned into the mixing reactor or be differently used, for example as heavy fuel oil.

Possible realizations of the method are exemplarily described by means of the drawing.

Herein:

FIG. 1 is a flow chart of the method.

In FIG. 1 a heat transfer medium coke having a temperature comprised between 500 and 700° C. is introduced from collecting bin (2) via pipe (3) into a mixing reactor (1). Simultaneously, residual oil having a temperature comprised between 100 and 400° C. is introduced via pipe (4) into the mixing reactor (1). During mixing, a conversion temperature of the mixture comprised between 450 and 600° C. is reached. The heat transfer medium coke in the mixing reactor (1) usually has a grain size in the order of 0.1 to 4 mm, such that an extensive separation of the coke from the gases and oil vapours generated in the mixing apparatus takes place at the exit of the mixing apparatus.

The mixing apparatus (1) comprises at least two intermeshing screws, which rotate in the same direction. The screws are of the type of a feed screw and have coiled conveyor paddles.

The hot, substantially oil free, granular coke leaves the mixing reactor (1) at the mixing apparatus exit with a temperature comprised between 450 and 600° C. and falls through a channel (7) into a post-degasifying bin (8), into the lower part of which a strip gas (9) can be introduced. Residual gases and vapours can escape upwards from the post-degasifying bin (8) through channel (7). Excess coke is extracted via pipe (2*a*), wherein a part of the coke can also be extracted via pipes (12*a*). The coke from pipe (12) runs over a pneumatic conveyor (10), which is provided with combustion air via pipe (5) and with fuel via pipe (6), into the collecting bin (2). During the upwards conveyance by means of the pneumatic conveyor (10) a part of the coke and/or the introduced fuel is simultaneously burned. The coke, which has been heated in the pneumatic conveyor (10), reaches the collecting bin (2), from which exhaust gas is evacuated via pipe (11).

The coke in the collecting bin (2) has temperatures comprised between 500 and 700° C.

The gaseous and vapourous products of the mixing reactor (1) are introduced via pipe (13) into a cyclone (14). Here, a separation of the fine coke particles takes place, which run via pipe (15) into the post-degasifying bin (8).

The gaseous and vapourous products flow from cyclone (14) through pipe (16) into a column (17), where they are quenched and thus cooled down from 450 through 600° C. to 350 through 450° C.

Returned $C_4$ product gas from vessel (23) or water vapour is introduced via pipe (24*a*) into the head of column (17). This reduces the partial pressure of the vapour product oil to such an extend that a heavy oil fraction having an initial boiling point between 450 and 650° C., in which nearly all pollutants are concentrated, condenses there at 350-450° C. Decomposition or coking of the condensed oil is thus prevented. The column is preferably a quench cooler with a downstream multi-venturi washer, in which the gases and vapours originating form the mixing reactor (1) are very efficiently cooled in a parallel flow and residual breeze is washed out with its own condensate. But other apparatuses can also be used for this purpose.

For reducing the portion of heavy oil having a high content of pollutants, the overlapping boiling range of VGO and VR is set at a temperature as high as possible and comprised between 450 and 650° C. This is achieved by introducing gas or water vapour into the head of column (17) via pipe (24*a*) and by cooling the gases and vapours by means of cooled heavy oil condensate from pipe (27*a*). The heavy oil condensate having a temperature comprised between 350 and 450° C. is extracted from the basin of column (17) via pipe (27), cooled down to the required temperature in a heat exchanger (25) and partially returned as cooling/washing medium to the head of column (17). The other part of the heavy oil condensate is extracted as product via pipe (27*b*). The heavy oil condensate from pipe (27*b*) can afterwards either be returned to the mixing reactor (1) or be differently used, for example as heavy heating oil.

The non condensed gas/oil vapour mixture is extracted from the lower part of column (17) via pipe (18). According to another realization of the invention, it can be introduced into a fractionating column (19). There, the remaining product oil is separated into VGO having a low content of pollutants and a pollutant free benzine/gas oil fraction. The VGO having a final boiling point of 450-650° C. is extracted via pipe (21) from the bottom of the fractionating column (19). The thus obtained VGO can afterwards be catalytically converted into benzine and gas oil in a non represented hydrocracker. The remaining gas/oil vapour mixture from the head of the fractionating column (19) is cooled in condenser (22) via pipe (20) and separated in vessel (23) into a benzine/gas oil fraction having a boiling range of e.g. $C_5$-360° C. and a $C_4$ gas. The benzine/gas oil fraction is extracted via pipe (26) and partially returned to the head of the fractionating column (19) via pipe (26*b*). The remaining benzine/gas oil mixture is evacuated as product via pipe (26*a*).

Non condensed $C_4$ gas is evacuated upwards from vessel (23) via pipe (24) and partly returned into column (17) via pipe (24*a*) and partly extracted as product via pipe (24*b*).

EXAMPLE 100 t/h residual oil having a temperature of 300° C. are introduced into the mixing reactor (1) via pipe (4). 75 t/h gas/oil vapour mixture having a temperature of 550° C. are introduced from mixing reactor (1) via pipe (13) into a cyclone (14) for dedusting. The remaining 25 t/h coke, together with heat transfer medium coke, are introduced via pipe (7) into the post-degasifying bin (8).

The gas/oil vapour mixture is routed from cyclone (14) via pipe (16) into a column (17), where it is diluted with gas and cooled down from 550° C. to 425° C. For this, column (17) is provided with 43 t/h $C_4$ gas from pipe (24*a*) and 55 t/h cooled heavy oil condensate having a temperature of 380° C. from pipe (27*a*).

65 t/h heavy oil condensate having an initial boiling point of 600° C. are extracted via pipe (27) from the bottom of column (17) and cooled down from 425° C. to 380° C. in a heat exchanger (25). Afterwards, 55 t/h cooled heavy oil condensate are returned to the head of column (17) via pipe (27*a*) and 10 t/h are extracted as product via pipe (27*b*).

108 t/h non condensed gas/oil vapour mixture are introduced from the lower part of column (17) via pipe (18) into a fractionating column (19). 40 t/h. VGO having a low content of pollutants and a temperature of 350° C. are extracted from the bottom of the fractionating column (19) via pipe (21). The remaining 68 t/h gas/oil vapour mixture are extracted from the head of the fractionating column (19) via pipe (20), cooled down to 43° C. in a condenser (22), introduced into vessel (23) and separated there into a liquid benzine/gas oil fraction having a boiling range of $C_5$-360° C. and a $C_4$ gas. 53 t/h $C_4$ gas are extracted via pipe (24) and 43 t/h thereof are returned into the head of column (17) via pipe (24*a*). The remaining 10 t/h $C_4$ gas are extracted as product via pipe (24*b*). Furthermore, 15 t/h benzine/gas oil mixture are extracted as product via pipe (26*a*).

In a single-stage condensation according to the state of the art, one would obtain 50 t/h residue having an initial boiling point of 360° C. instead of 10 t/h heavy oil condensate having an initial boiling point of 600° C. Even with an extensive vacuum distillation, one could only obtain 20 t/h VGO having a low content of pollutants and a boiling range comprised between 360 and 510° C. from the residue according to the state of the art. However, according to this invention, 40 t/h VGO having a low content of pollutants and a boiling range comprised between 360 and 600° C., i.e. the double quantity, can be obtained in a technically simpler manner.

The invention claimed is:

1. A method for high temperature short-time distillation of a residual oil originating from the processing of crude petroleum, natural bitumen or oil sand, wherein in a mixing apparatus (1) the residual oil is mixed with granular hot coke as heat transfer medium, converted into oil vapour, gas and coke, and wherein the gas and oil vapour are evacuated from the mixing apparatus (1) while being substantially separated from the granular coke, and wherein the gas and the vapour are cooled down to produce oil in form of condensate as well as gas, and wherein the coke, which has been evacuated from the mixing apparatus (1), is heated again and returned into the mixing apparatus (1) as heat transfer medium, characterized in that the oil vapour and the gas is partially condensed in a column (17) at temperatures beneath 450° C. while adding gas or water vapour to the column (17) for reducing partial pressure, and wherein a high-boiling fraction is extracted from the column (17) and non condensed gas and oil vapour are evacuated from the column (17).

2. A method according to claim 1, characterized in that the non condensed gas and oil vapour from said column (17) are introduced into a second fractionating column (19), in which the product oil, which has not been condensed in the first column (17), is decomposed into vacuum gas oil having a low content of pollutants as well as a benzine/gas oil fraction.

3. A method according to claim 1, characterized in that the gas introduced into said column (17) to reduce the partial pressure is the non condensed gas coming from the column (17).

4. A method according to claim 1, characterized in that the partial pressure of the product oil in column (17) is reduced to such an extend that at temperatures beneath 450° C. a highly boiling fraction having an initial boiling point between 450° C. and 650° C. can be condensed and separated from the other product oil fractions.

5. A method according to claim 4, characterized in that the separated highly boiling fraction contains more than 60% of the Conradson carbon residue (CCR), which is still contained in the product oil vapour, more than 70% of the heavy metals nickel (Ni) and vanadium (V), which are still contained in the product oil vapour, as well as more than 80% of the asphaltenes, which are still contained in the product oil vapour.

6. A method according to claim 1, characterized in that the gas and the oil vapour evacuated from the mixing apparatus (1) are dedusted in a cyclone (14) before being introduced in said column (17).

7. A method according to claim 1, characterized in that said column (17) is a quench cooler with a downstream multi-venturi washer, in which the gas and vapour originating form the mixing apparatus (1) are cooled and residual breeze is washed out.

8. A method according to claim 4, characterized in that the high boiling fraction, which has been separated in said column (17), is returned into said mixing apparatus (1).

* * * * *